US005450048A

United States Patent [19]

Leger et al.

[11] Patent Number: 5,450,048

[45] Date of Patent: Sep. 12, 1995

[54] CIRCUIT BREAKER COMPRISING A REMOVABLE CALIBRATING DEVICE

[75] Inventors: Jean-François Leger; Gilles Savoyat, both of Grenoble, France

[73] Assignee: Merlin Gerin, France

[21] Appl. No.: 217,329

[22] Filed: Mar. 23, 1994

[30] Foreign Application Priority Data

Apr. 1, 1993 [FR] France ..... 93 03960

[51] Int. Cl.[6] ..... H01H 67/02

[52] U.S. Cl. ..... 335/132; 335/202; 361/614

[58] Field of Search ..... 361/614, 652; 335/132, 335/202, 42, 35, 167–176

[56] References Cited

U.S. PATENT DOCUMENTS 4,595,812 6/1986 Tamaru et al. ..... 335/132
4,603,313 7/1986 Shimp et al. .
4,728,914 3/1988 Morris et al. .
4,884,048 11/1989 Castonguay et al. .
4,979,437 11/1989 Dard et al. ..... 361/211
5,027,091 6/1991 Lesslie et al. ..... 335/132

FOREIGN PATENT DOCUMENTS 2583569 12/1986 France .

*Primary Examiner*—Lincoln Donovan
*Attorney, Agent, or Firm*—Parkhurst, Wendel & Rossi

[57] ABSTRACT

A removable calibrating unit comprises a body, a front panel and a part in the form of a reversible ramp. The reversible ramp comprises an end close to the front panel and an end away from the front panel. Extraction of the removable unit is achieved by means of a pin comprising an extraction lug. When the pin is subjected to rotational movement in one direction, the lug moves from the end close to the front panel to the end away from the front panel and results in extraction of the unit by applying thereon a force separating the unit from the circuit breaker.

9 Claims, 7 Drawing Sheets

CIRCUIT BREAKER COMPRISING A REMOVABLE CALIBRATING DEVICE

BACKGROUND OF THE INVENTION

The invention relates to a circuit breaker comprising a removable calibrating unit comprising an external face.

Calibrating devices for circuit breakers are generally fitted on electronic trip devices. They essentially serve the purpose of limiting the rating of the circuit breaker to a value lower than or equal to the rated current. For example, for a circuit breaker whose rated current is 1000 A, the calibrating device can set the rating to 500, 600, 800 or 1000 A by means of removable units. If the 800 A unit is fitted on the trip device, the rating will then be 800 A, and the overload tripping threshold setting will be lower than or equal to 800A. To prevent assembly errors, an error prevention device prevents units being fitted which are not part of the series corresponding to the circuit breaker. An error prevention device of this kind is described in the Patent FR-A-2,583,569. The removable units comprise, in state-of-the-art manner, electronic components connected to pins. When the unit is fitted in the trip device, the pins are connected to connectors so as to connect the electronic components of the unit to circuits of the trip device. These components are generally resistors, memories or more complex logic circuits.

In addition to calibrating the maximum overload current, the units can serve the purpose of setting the parameters of other functions of the trip device, notably earth fault protection, instantaneous or short-circuit tripping current value, indication of tripping faults or implementation of additional functions. The calibrating units can also comprise means for adjusting the overload current threshold. In a state-of-the-art manner, these means are potentiometers or switches and resistors.

The removable units are generally fixed by screws. If these screws are metallic the insulation distances between the front panel of the circuit breaker or trip device and the electrical part are reduced. In the case where the screws are made of insulating material repeated operations progressively wear out the thread of the fixing means.

SUMMARY OF THE INVENTION

The object of the invention is to achieve a device for fixing removable units for a circuit breaker or trip device allowing a sufficient insulation distance between the front panel and the electrical parts of the circuit breaker.

According to the invention the removable unit comprises, inside the unit, at least one reversible ramp comprising a first end, located at a first preset distance from said external face, and a second end, located at a second preset distance, smaller than the first, from said face, the unit comprising a pin accessible from the external face and comprising at least one support component cooperating with the ramp to extract the unit from the circuit breaker housing when rotation of the pin is performed.

According to a preferred embodiment of the invention, the removable unit comprises a base plate provided with an orifice for the pin to pass through, the pin bearing on the bottom of the housing.

According to a development of the invention, the removable unit comprises at least 2 reversible ramps, the pin located between the reversible ramps comprising an extraction lug associated with each reversible ramp.

BRIEF DESCRIPTION OF THE DRAWINGS

Other advantages and features will become more clearly apparent from the following description of illustrative embodiments of the invention, given as non-restrictive examples only and represented in the accompanying drawings in which.

DETAILED DESCRIPTION OF THE PREFERRED EMBODIMENT

Figure 1:
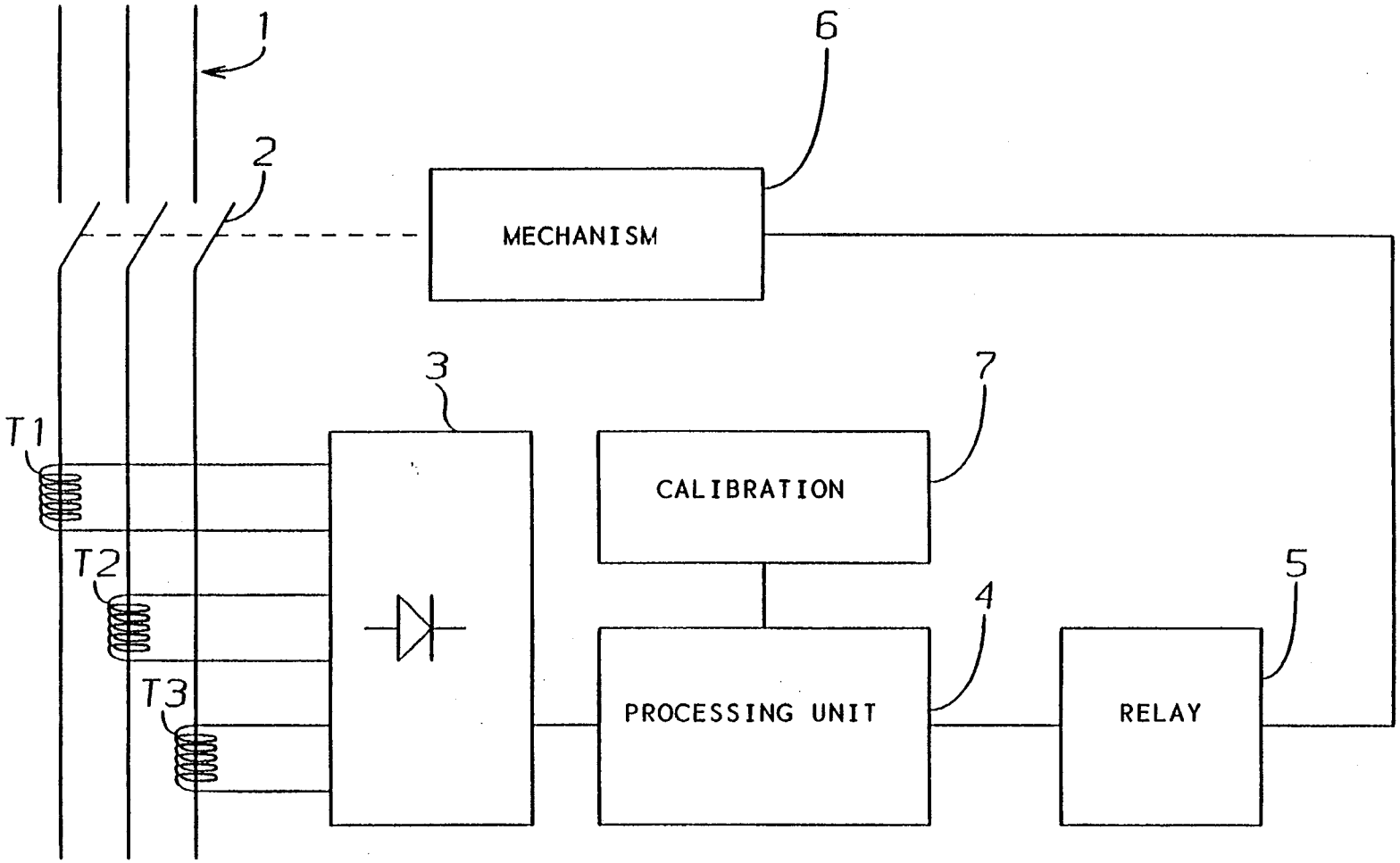
FIG. 1 represents the simplified block diagram of an electrical circuit breaker in which a device comprising the invention can be implemented.

FIG. 1 represents a state-of-the-art circuit breaker. An electrical power system 1 to be protected is composed of electrical conductors connected to contacts 2 enabling the current to be established or interrupted. Current sensors T1, T2, T3 associated with the different power system conductors transform the primary currents of high value into secondary currents compatible with electronic trip devices. The secondary currents are applied to the input of a rectifying and detection circuit 3. This circuit supplies signals representative of the currents to an electronic processing unit 4. A tripping order produced by the processing unit 4 is applied to the input of the operating relay 5 which actuates an opening mechanism 6 of the circuit breaker contacts 2.

In some systems the maximum overload current value must be limited to a value lower than or equal to the rated current of the circuit breaker. This value is, in a state-of-the-art manner, set by means of a calibrating device 7 connected to the processing unit 4. Whatever the rated current of the circuit breaker, the current sensors always supply the same secondary current corresponding to the rated current. This makes it possible to manufacture a single type of trip device corresponding to several sizes of circuit breaker. A range of removable units enables the rating of a circuit breaker to be changed while keeping the same rated current.

Figure 2:
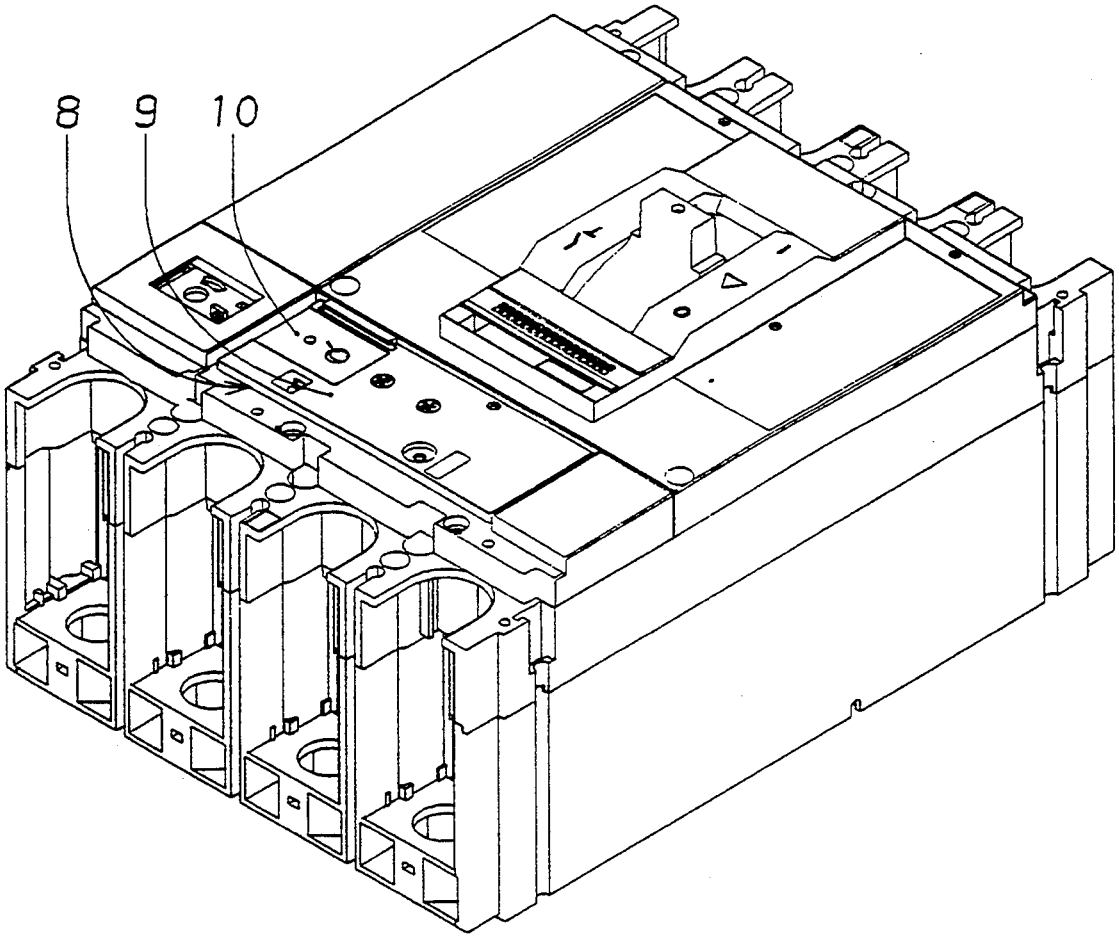
FIG. 2 represents a complete view of a circuit breaker according to FIG. 1.

A complete view of a circuit breaker is represented in FIG. 2. The circuit breaker comprises a trip device 8 with a front panel 9 receiving a removable calibrating unit 10.

Figure 3:
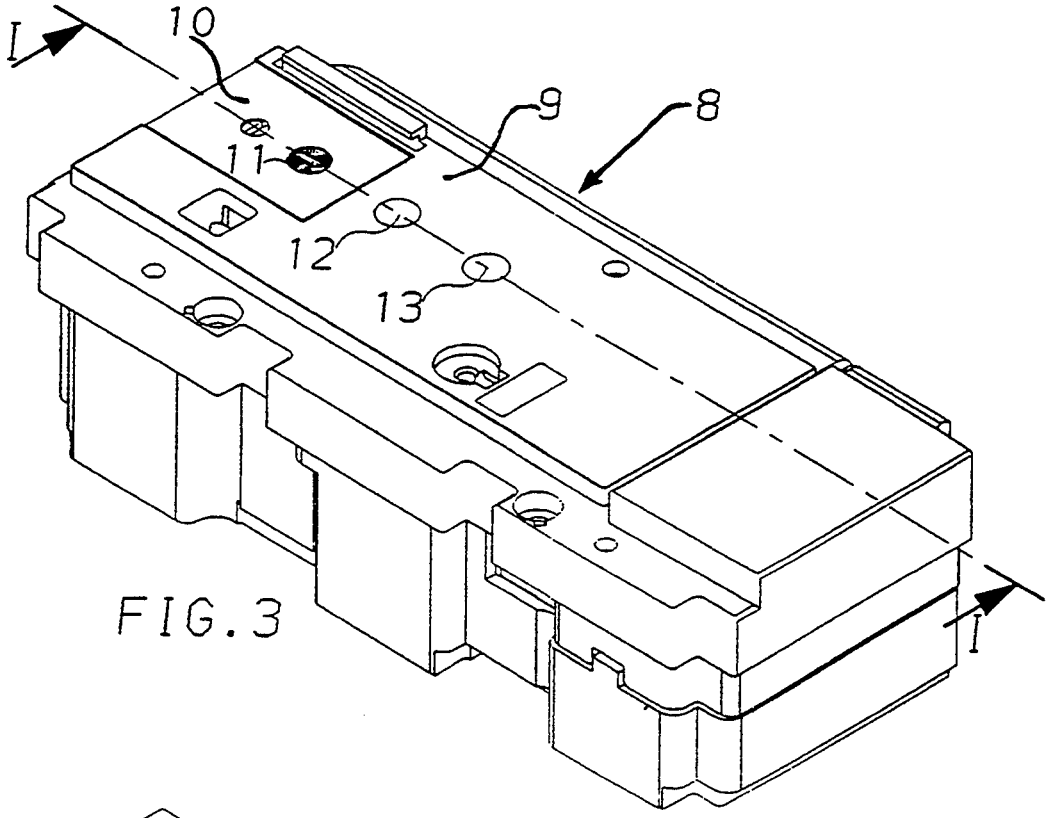
FIGS. 3 and 4 show a trip device of a circuit breaker according to FIG. 2 comprising a removable calibrating unit.
Figure 4:
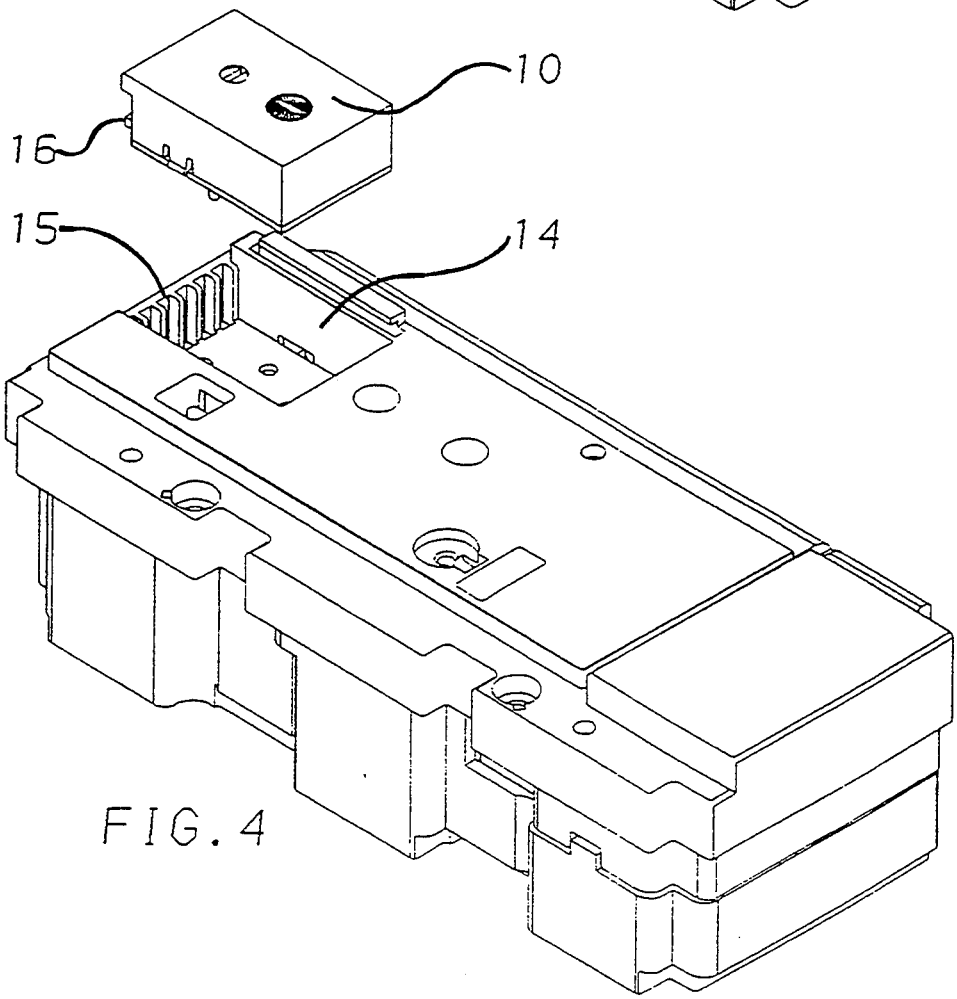

FIG. 3 represents a global view of the trip device 8. It generally contains the processing unit 4 and rectifying circuit 3. Adjustment devices 11, 12 and 13, appearing on the front panel and/or on the removable unit, enable the tripping, current threshold and time delay parameters to be adjusted. In FIG. 4, the removable unit 10 is removed from a housing 14 provided in the trip device 8. Grooves 15, on one side of the housing, enable error prevention pins 16 forming part of the removable unit to be received or blocked.

Figure 5:
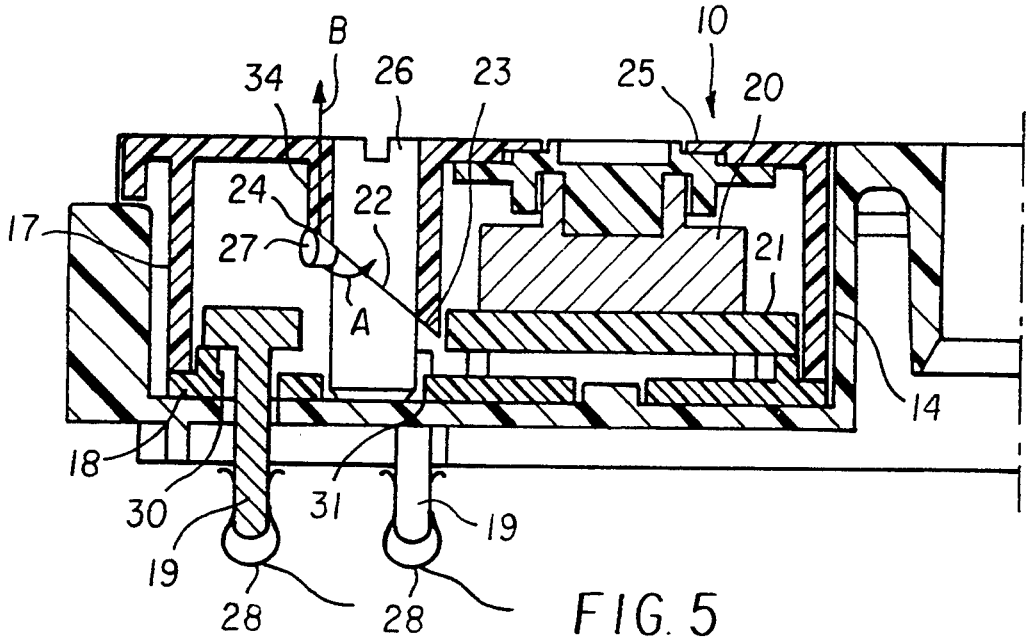
FIGS. 5 and 6 illustrate in greater detail a removable calibrating unit according to a particular embodiment of the invention.
Figure 6:
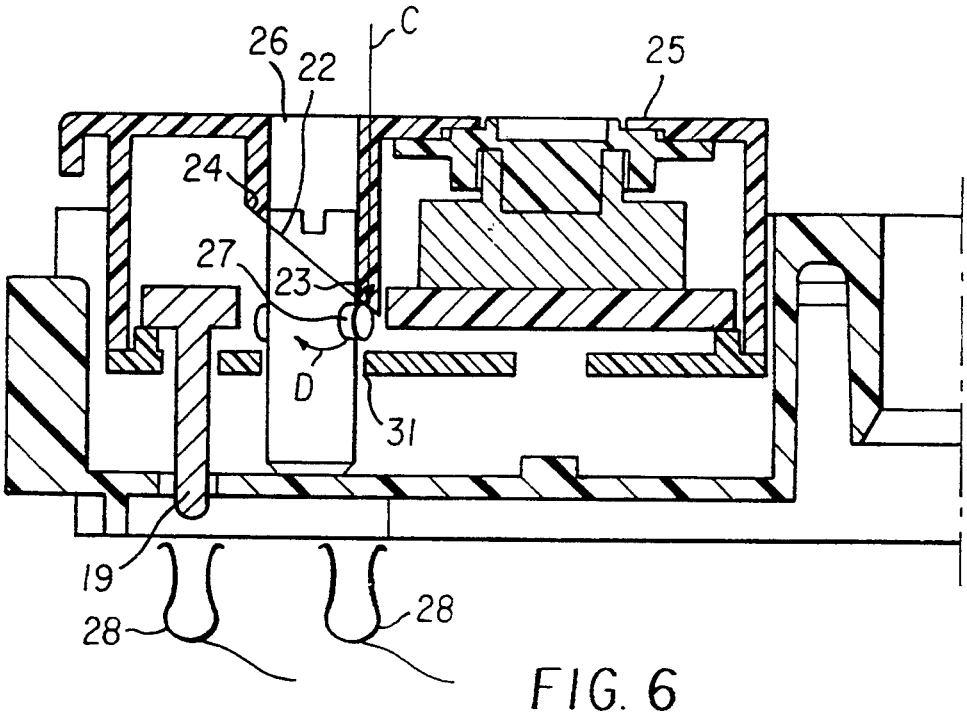

A schematic sectional view of an embodiment of the removable calibrating unit 10 is represented in FIG. 5. The removable calibrating unit 10 is placed inside its housing 14, in its normal operating position. It comprises a body 17 made of insulating material. The body 17 comprises a base plate 18 on which there are fixed electrical contact pins 19 which pass via orifices 30 through the base plate. The unit 10 comprises electronic components 20, able to be mounted on a printed circuit 21, and connected to the pins 19. The unit comprises a hollow part 34, cylindrical in FIGS. 5 and 6, comprising inside the unit, an end surface in the form of a reversible ramp 22. The reversible ramp 22 comprises an end 23 located a first preset distance from the external front panel 25 of the unit 10, and an end 24 located a second preset distance, smaller than the first, from the face 25.

An extraction pin 26, passing through the hollow part 34, passes via an orifice 31 formed in the base plate 18 of the body of the unit so as to come into contact with the casing of the trip device in the bottom of the housing 14. The pin 26, preferably made of insulating material, is accessible via the front panel 25 so as to be able to be operated by a simple tool such as a screwdriver or spanner. The pin 26 comprises an extraction lug 27 which cooperates with the reversible ramp 22.

When the unit is in the fitted position (FIG. 5), the lug is close to the end 24, and no force is applied on the reversible ramp. The pins 19 are connected to circuits of the trip device by means of connectors 28 represented schematically in FIGS. 5 and 6. If a rotational movement is applied to the pin 26 by a tool in the direction A, the lug 27 moves from the end 24 in the direction of the end 23 of the ramp. This movement exerts a repulsion force B on the ramp, thus pushing the calibrating unit out of its housing. When the lug 27 reaches the end 23, the pins 19 are no longer connected to the connectors 28 and the unit 10 is released from its housing. The unit 10 is then in the withdrawn position represented in FIG. 6, and replacement of the unit is, in this position, easy to perform.

Fitting the unit 10 in its housing is achieved by simply pressing on the front panel 25 of the unit. The reversible ramp presses on the lug 27 with a force C (FIG. 6) giving the pin 26 and its lug 27 a rotational movement. This movement moves the lug 27 from the end 23 to the end 24. When the base plate 18 of the unit 10 is in contact with the casing of the trip device, the lug 27 takes the inserted position represented in FIG. 5 and the pins are in electrical contact with the connectors 28.

Figure 7:
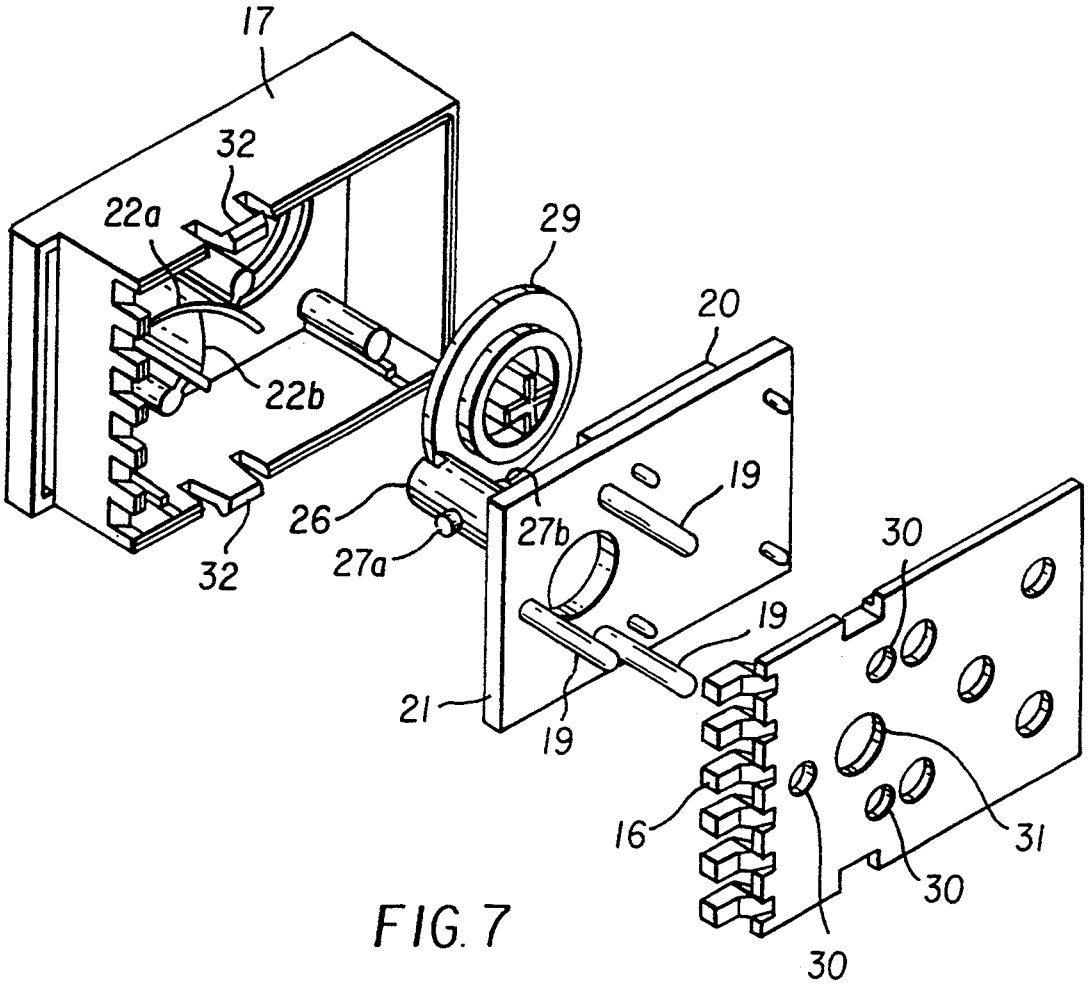
FIGS. 7 and 8 represent exploded views of another particular embodiment of a removable unit.
Figure 8:
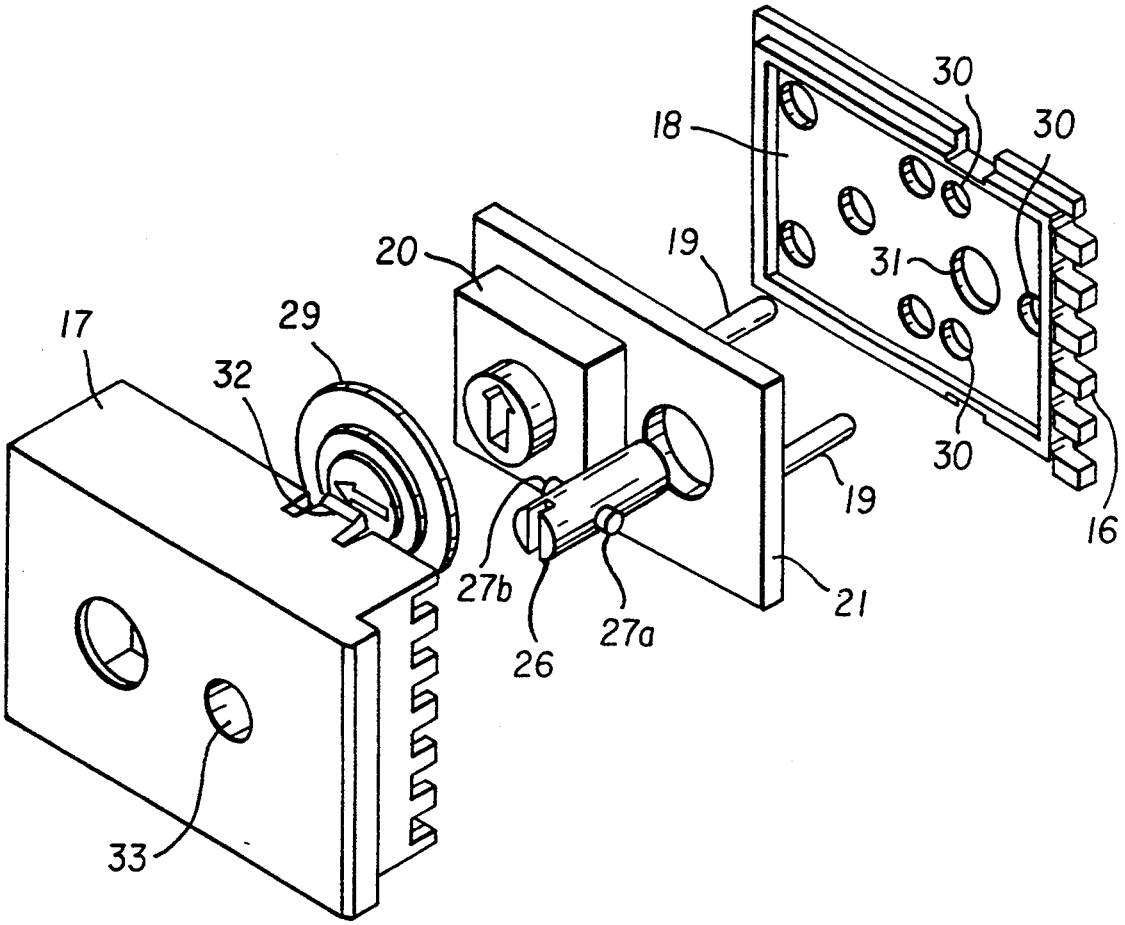

Another embodiment of a unit is represented in FIGS. 7 and 8. The body 17 is made up of two parts, a cover and the base plate 18, and comprises tabs 32 for holding the unit in its housing. The hollow part 34 of the unit comprises two reversible ramps **22*a* and 22*b*. The pin 26 comprises two lugs 27*a* and 27*b*, diametrically opposed in the figure, designed to exert a force on each of the ramps 22*a* and 22*b*. The printed circuit 21 bears the contact pins 19 and electronic components, notably a selector switch 20 controlled by an operating knob 29. The base plate 18 of the body of the unit comprises orifices 30 and 31 for the contact pins and extraction pin to pass through respectively. The base plate 18 also comprises error prevention lugs 16 which prevent assembly errors. The extraction pin is operated, via an orifice 33 formed in the cover, by means of a simple screwdriver. When extraction takes place, the pin acts symmetrically on the two ramps with its two lugs 27*a*, 27*b***, diametrically opposite with respect to the axis of the pin.

Figure 9:
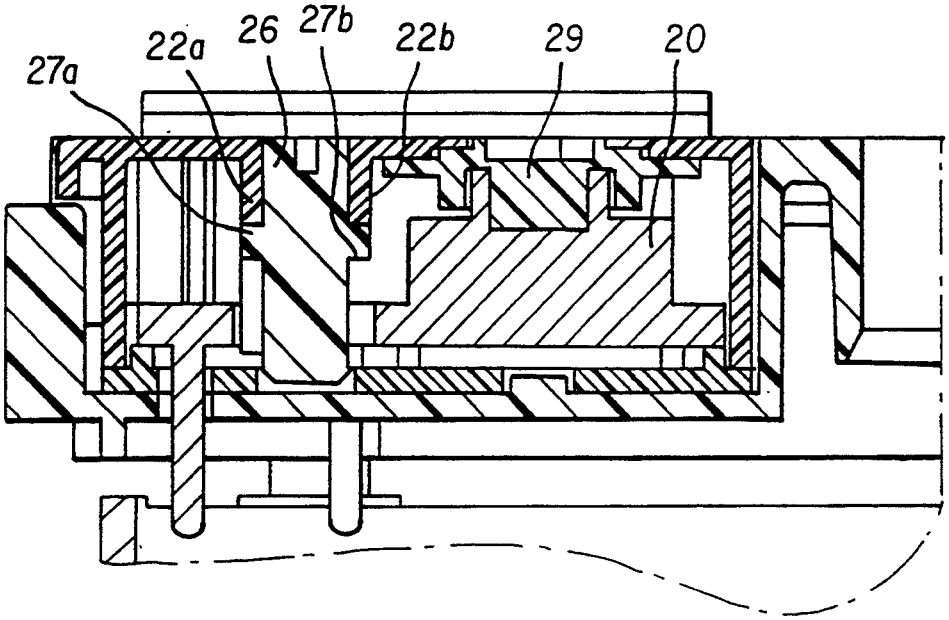
FIG. 9 is a partial cross-sectional view along the line I—I of FIG. 3 showing the removable unit of FIGS. 7 and 8 fitted in the trip device of FIG. 3.

FIG. 9 represents a partial cross-sectional view, along the line I—I of the unit of FIGS. 7 and 8 fitted in the trip device of FIG. 3. This view shows the position of the pin 26 in the unit and the cooperation of the lugs **27*a* and 27*b* and reversible ramps, respectively 22*a* and 22*b***.

In the embodiments described above, the removable unit is fitted in the trip device, but it could be fitted on another part of the circuit breaker. The extraction pins comprise lugs, but other shapes can be suitable to transmit the extraction force to the reversible ramp. The position of the extraction device in the unit, corresponding to the ramp and to the pin, is not critical, and it may depend on the shape of the unit, the electronic components or aesthetic criteria of the circuit breaker front panel.

We claim:

1. A circuit breaker having a housing, comprising:

a removable calibrating unit comprising an external face and housing therein (i) at least one ramp comprising a first end located at a first preset distance from said external face, and a second end located at a second preset distance from said external face, said second preset distance being shorter than the first preset distance, (ii) an extraction pin accessible from the external face, and (iii) at least one support component cooperating with the ramp to extract the unit from the circuit breaker housing when rotation of the extraction pin is performed.

2. The circuit breaker according to claim 1, wherein the removable unit further comprises a base plate having an orifice for passage of a contact pin therethrough, the contact pin bearing on the bottom of the housing.

3. The circuit breaker according to claim 1, wherein said at least one support component comprises a lug.

4. The circuit breaker according to claim 1, wherein the removable calibrating unit comprises a body, the extraction pin and the body of the removable calibrating unit being made of electrically insulating material.

5. The circuit breaker according to claim 1, wherein the removable calibrating unit comprises at least two ramps, and the extraction pin is located between the ramps and comprises an extraction lug associated with each ramp.

6. The circuit breaker according to claim 1, wherein the extraction pin is adapted to be rotated in an unscrewing direction by means of a screwdriver type tool.

7. The circuit breaker according to claim 1, wherein the removable unit comprises an error prevention device.

8. The circuit breaker according to claim 1, wherein the removable unit comprises connectors, electronic components and a setting selector switch.

9. The circuit breaker according to claim 1, wherein the housing is formed in a trip device of the circuit breaker.

* * * * *